United States Patent [19]

Rise, III

[11] 4,179,173

[45] Dec. 18, 1979

[54] SHORTING CONTACT FOR USE WITH A MALE PIN BOARD

[75] Inventor: Samuel F. Rise, III, Holmdel, N.J.

[73] Assignee: Bell Telephone Laboratories, Incorporated, Murray Hill, N.J.

[21] Appl. No.: 3,103

[22] Filed: Jan. 15, 1979

Related U.S. Application Data

[63] Continuation of Ser. No. 886,557, Mar. 14, 1978, abandoned.

[51] Int. Cl.[2] ..... H01R 33/54

[52] U.S. Cl. ..... 339/19; 200/51.1; 339/220 R

[58] Field of Search ..... 339/19, 17 C, 220 R; 200/51.1

[56] References Cited

U.S. PATENT DOCUMENTS

| | | | |
|---|---|---|---|
| 2,898,518 | 8/1959 | Lynn | 339/17 C |
| 3,902,776 | 9/1975 | Williams et al. | 339/17 C |
| 3,918,784 | 11/1975 | Lemke et al. | 339/17 C |
| 3,997,228 | 12/1976 | Gluntz | 339/17 CF |
| 4,017,696 | 4/1977 | Falk | 179/175 |
| 4,061,410 | 12/1977 | Kubik | 339/113 B |
| 4,070,557 | 1/1978 | Ostapovitch | 339/19 |

*Primary Examiner*—Neil Abrams
*Attorney, Agent, or Firm*—Richard J. Roddy

[57] ABSTRACT

Circuit boards equipped with conductive paths are commonly adapted to fit into a suitable female connector. At times, protrusions of contact fingers within the female connector are bent to provide an electrical circuit closure, or short, between the bent fingers. As a male circuit board is plugged into the connector, the shorted fingers separate and electrically open. That common state of the prior art ignores the need for an arrangement for shorting pins in a male pin field. This problem is solved by a shorting contact (100) comprising an electrically conductive, folded cantilever spring. The contact, which is mounted on the board (10), mechanically touches predetermined ones (11-1, 11-2) of a plurality of male pins (11). Thereby, the predetermined pins are shorted together. Also, as the female connector (20), which may be lead connected to a printed wiring board, is fitted over the pins, an insulating housing (21) of the connector touches an arm (125) of the contact. As the arm is compressed, the mechanical touching between the contact and the predetermined pins is removed, thusly the electrical short is also removed.

2 Claims, 3 Drawing Figures

SHORTING CONTACT FOR USE WITH A MALE PIN BOARD

CROSS REFERENCE TO RELATED APPLICATIONS

This is a continuation of application Ser. No. 886,557, filed Mar. 14, 1978 now abandoned.

TECHNICAL FIELD

This invention relates to a connector arrangement and, in particular, to a shorting contact connector arrangement.

BACKGROUND ART

The use of circuit boards to mount electrical circuitry is commonplace. Usually, a circuit board is equipped with conductive paths and is adapted to fit into a suitable connector, for example, a male circuit board may plug into a front slot of a female connector. Such an arrangement is disclosed in U.S. Pat. No. 4,017,696 issued to R. J. Falk on Apr. 12, 1977 and entitled "Initializing Circuit". In that connector arrangement, protrusions of contact fingers within a female connector are bent to provide an electrical circuit closure, or electrical short, between the bent fingers. As the male circuit board is plugged into the connector slot, the conductive paths on the board mechanically touch the shorted fingers. As the board is pushed deeper into the slot, the shorted fingers separate, and hence electrically open. Too, as the fingers separate, an electrical contact is made between the opened fingers and the conductive paths on the board. Thereby, electrical circuitry, which is mounted on the board, is connected to other electrical circuitry typically extended, perhaps by wire-wrapped leads, to rear protrusions of the connector.

Known prior art shorting arrangements are of the aforedescribed type wherein shorting contacts may be included in a female connector. The prior art limitation ignores the need for a connector arrangement for shorting predetermined pins in a male pin field.

DISCLOSURE OF THE INVENTION

This and other prior art problems are solved with the instant shorting contact arrangement for use with a male pin field.

According to one aspect of the invention, a shorting contact, which is mountable on a board, mechanically touches predetermined ones of a plurality of male pins, which are secured to the board. The contact comprises an electrically conductive folded spring, which, when it mechanically touches the predetermined pins, provides a circuit closure for shorting the pins.

According to another aspect of the invention, the shorting contact includes a base, which is secured to the board, and a leg extending from the base through a curvature of the contact to an arm. The contact is structurally strengthened in order that, as the arm mechanically touches the pins, sufficient force is placed against the shorted pins to maintain a secure circuit closure.

According to another aspect of the invention, a female connector, when fitted over the pins, compresses the arm away from the predetermined pins thereby removing, or opening, the circuit closure.

DETAILED DESCRIPTION

Figure 1:
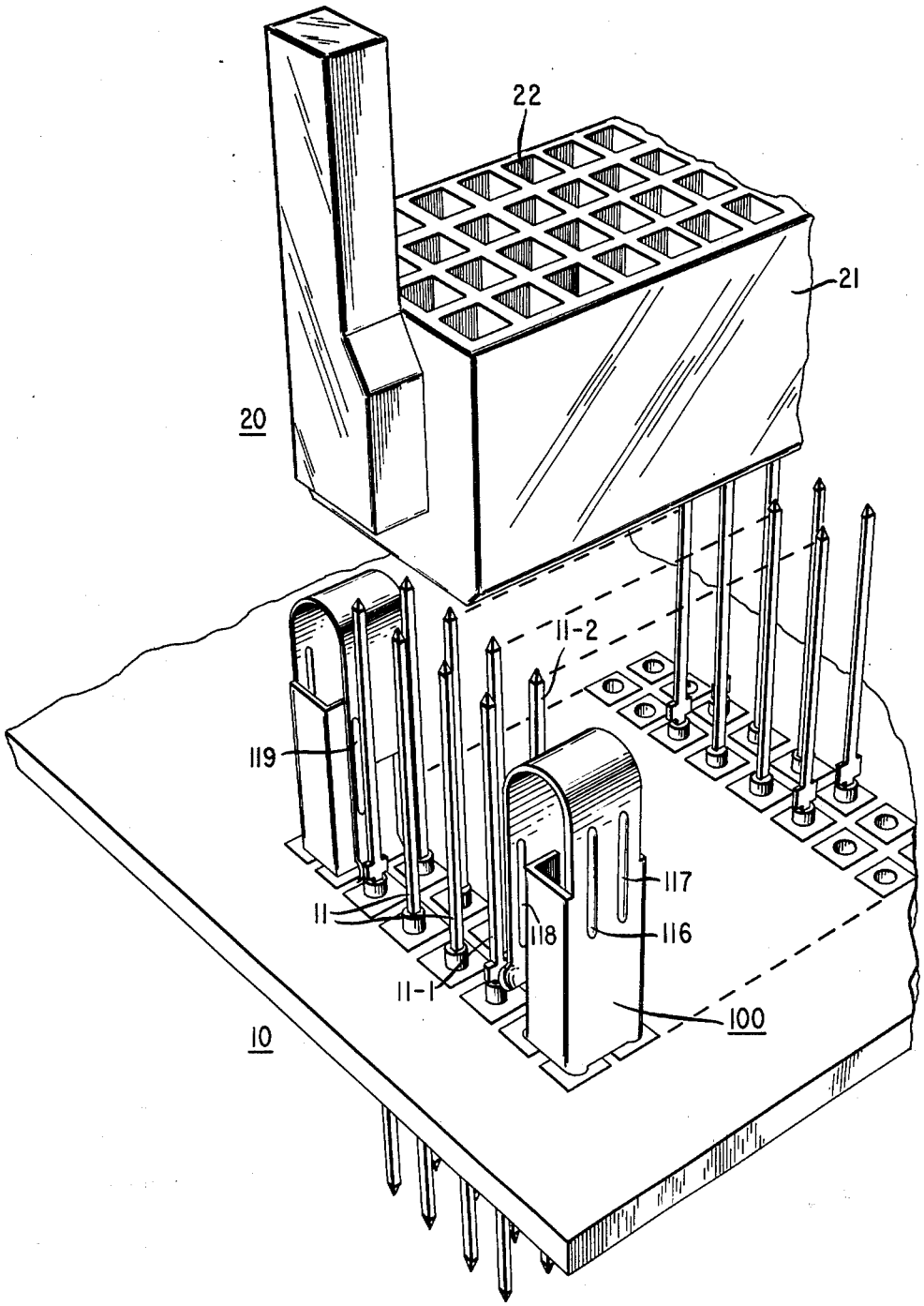
FIG. 1 is a perspective view of a back plane board having a plurality of pins secured thereto and a view of a female connector about to be fitted over the pins, the import of which would be to open a circuit closure obtained, in accordance with the principles of the invention, by a shorting contact.

Illustrated in FIG. 1 is back plane board 10 having a plurality of male interconnection pins 11 secured thereto in a generally perpendicular fashion. Some of pins 11, for example, adjacent pins 11-1 and 11-2, protrude through board 10. To the bottom side of the back plane board 10, an interconnection (not shown) such as a wire-wrapped interconnection may be made to the protruding pins for connecting same to an electrical system. To the top side of back plane board 10, female connector 20 is adapted to fit, e.g., adapted to be plugged, over parallel rows of regularly spaced pins 11. Standard connector 20 includes an insulating housing 21 having a plurality of receptacles mounted in recesses 22 of the housing. As connector 20 is plugged over pins 11, an electrical circuit is established between the electrical system and the circuitry mounted on the printed wiring board (not shown). The printed wiring board is connectable by leads through the topside of female connector 20 to the receptacles.

Figure 2:
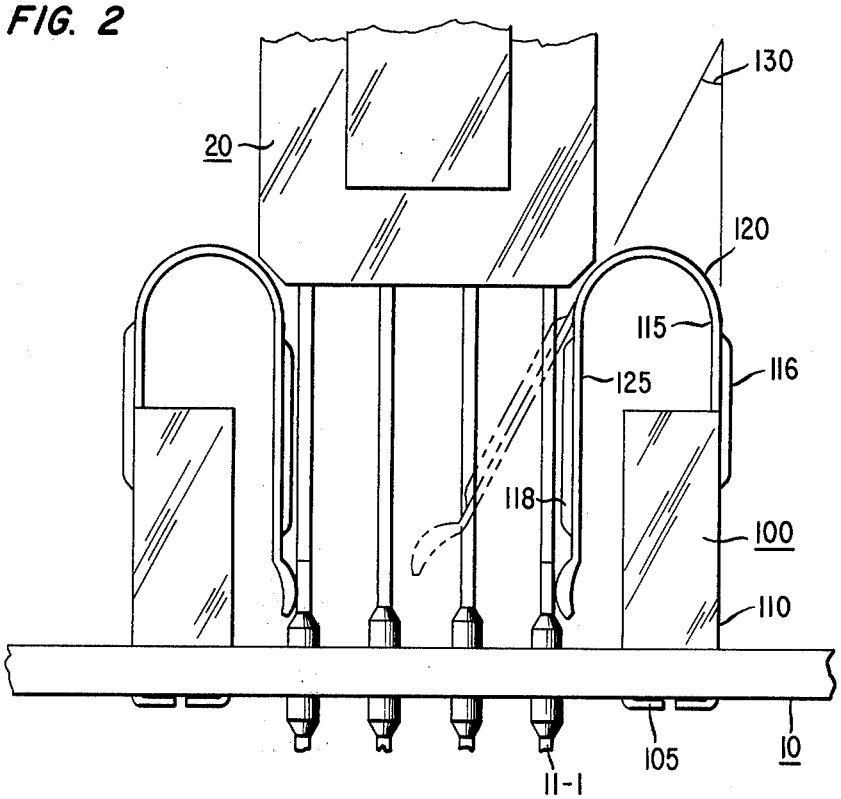
FIG. 2 is an end view of the arrangement shown in FIG. 1.
Figure 3:
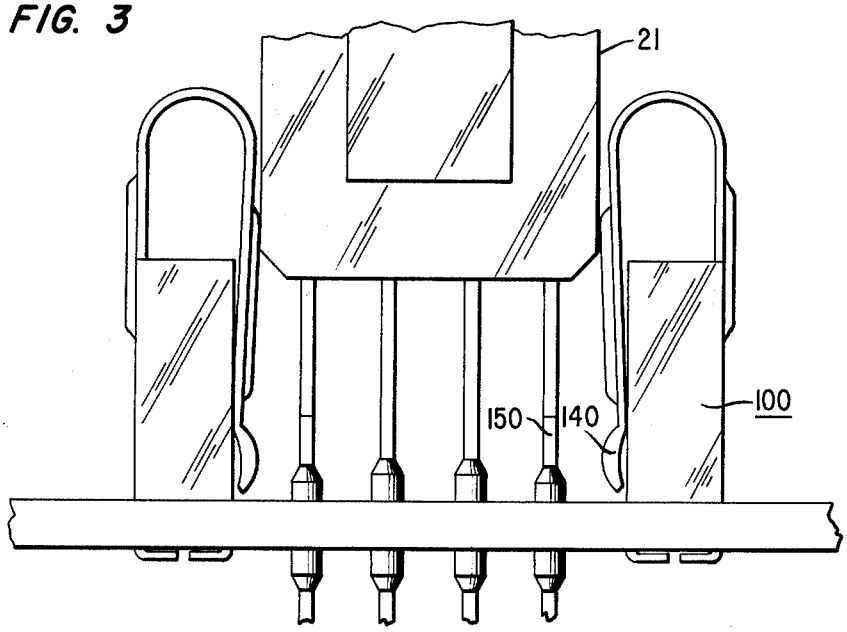
FIG. 3 is an end view of the arrangement shown in FIG. 1 after the female connector has been partially fitted over the pins for opening the circuit closure.

In addition, and unlike the known art, back plane board 10 includes one or more shorting contacts for providing an electrical circuit closure, or short between two or more predetermined ones of pins 11. Clearly, the pins to be shorted need not be adjacent to each other. However, in the interest of brevity and not by way of limitation, the following description assumes a short is to be provided between adjacent pins 11-1 and 11-2. In FIGS. 1, 2 and 3, two shorting contacts are illustrated juxtaposed parallel rows of pins 11. Again, for ease of description, discussion is limited to contact 100. Illustrative contact 100 may be fabricated as a folded cantilever spring from an electrically conductive material such as a phosphor bronze. On the one hand, absent connector 20 being fitted over pins 11, i.e., a situation such as is illustrated in FIGS. 1 and 2, predetermined pins 11-1 and 11-2 are electrically shorted together. Specifically, shorting contact 100 includes contact surface 140, here illustrated as a spoonlike, spherical surface, for providing a point contact as surface 140 mechanically touches pin area 150, here illustrated as a flat area situated near the base of a pin to be shorted. Thereby, an electrical circuit closure is established between predetermined pins 11-1 and 11-2 by way of shorting contact 100. On the other hand, with connector 20 being plugged over pins 11, i.e., a situation such as is illustrated in FIG. 3, the aforedescribed circuit closure is opened by way of insulating housing 21 of connector 20 pushing against arm 125 of shorting contact 100. Inasmuch as the contact surface is thusly forced away from the pin contact area, the circuit is opened.

A side view of shorting contact 100 is shown in FIG. 2. Contact 100 comprises a folded cantilever spring having box-shaped base member 110 for securing the contact to back plane board 10 and for giving structural strength to the contact. Contact 100 may be secured to back plane board 10, for example here by four protrusions 105 from base 110, which extend through, and are bent against, the bottom side of back plane board 10. Extending upward from base 110 is leg 115 having dimples 116 and 117 for strengthening the leg, each dimple being approximately aligned with a pin to be shorted. Leg 115 is bent through a curvature 120 downward through arm 125 to impart a generally inverted U-shaped appearance to contact 100. Arm 125 also includes two tension members, each having a strengthening dimple and each being aligned with a leg dimple and a pin to be shorted. For example, in FIG. 1, arm dimple 118 is shown aligned with leg dimple 116 and pin 11-1. A dimple may be obtained by a longitudinal, stressed indentation of the contact. The tip of each tension member of arm 125 is bent in a concave manner from base 110 to form generally spoonlike, spherical contact surface 140 juxtaposed the contact area of a pin to be shorted. Here, each contact surface 140 touches a pin contact area 150 of each of pins 11-1, 11-2. Thereby, an electrical path obtains between pins 11-1 and 11-2 by way of shorting contact 100.

It may be noted that absent pins 11, arm 125 would spring outward in a direction away from base 110 forming an angle 130 at a point obtained by extending arm 125 and leg 115. In reducing angle 130, contact 100 is compressed through curvature 120 to obtain a spring-like force, which force is applied to a point on the pin to be shorted, i.e., the pin contact area, through a contact surface 140. In FIG. 3, as connector 20 is pushed or forced down over pins 11, insulating surface 21 comes in mechanical contact with arm 125. Responsive to the downward force on connector 20, arm 125 is forced away from the shorted pins. Thereby, the electrical closure is removed and the short opened. At the same time, contact 100 is further compressed. As a result, removal of connector 20 permits reestablishment of the circuit closure between shorting contact 100 and the predetermined pins.

I claim:

1. Apparatus for forming electrical connections between leads and pins (11) extending from a board (10), said pins being adapted to receive a female connector (20), said connector having an insulating body (21) and being adapted to fit over said pins and being further adapted to connect to said leads, and characterized in that said apparatus further comprises a free standing folded spring contact (100) for shorting pins and adapted for mounting on said board, said contact including a generally box-shaped base (110) for securing said contact to said board and for providing a structural strengthening of said contact, a strengthened (116, 117) cantilever leg (115) extending from said base through an inverted generally U-shaped, concave curvature (120) to a strengthened (118, 119) arm (125) of said spring, said curvature enclosing said base, said arm having a spoonlike, sperical contact surface (140) juxtaposed each pin to be shorted and being adapted to touch an area (150) of predetermined ones (11-1, 11-2) of said pins whereby an electrical short occurs between said predetermined pins.

2. The apparatus defined in claim 1 wherein said arm (125) of said shorting contact (100) is juxtaposed said predetermined pins, said arm being flexibly compressable and compressing responsive to said connector (20) being fitted over said pins (11) and responsive to said insulating body (21) of said connector mechanically forcing said arm away from said predetermined pins whereby said electrical short is removed.

* * * * *